US010998631B2

(12) United States Patent
Duan

(10) Patent No.: US 10,998,631 B2
(45) Date of Patent: May 4, 2021

(54) ANTENNA SYSTEM

(71) Applicant: Sercomm Corporation, Taipei (TW)

(72) Inventor: Jhih-Hao Duan, Taipei (TW)

(73) Assignee: SERCOMM CORPORATION, Taipei (TW)

( * ) Notice: Subject to any disclaimer, the term of this patent is extended or adjusted under 35 U.S.C. 154(b) by 186 days.

(21) Appl. No.: 16/263,418

(22) Filed: Jan. 31, 2019

(65) Prior Publication Data

US 2019/0252778 A1 Aug. 15, 2019

(30) Foreign Application Priority Data

Feb. 13, 2018 (CN) ..... 201820255966.3

(51) Int. Cl.
*H01Q 5/48* (2015.01)
*H01Q 21/30* (2006.01)
*H01Q 9/26* (2006.01)

(52) U.S. Cl.
CPC ..... *H01Q 5/48* (2015.01); *H01Q 9/26* (2013.01); *H01Q 21/30* (2013.01)

(58) Field of Classification Search
CPC ..... H01Q 5/48; H01Q 21/30; H01Q 9/26; H01Q 7/00; H01Q 21/28; H01Q 25/00; H01Q 1/521; H01Q 1/52; H01Q 5/371
See application file for complete search history.

(56) References Cited

U.S. PATENT DOCUMENTS 9,960,499 B2 * 5/2018 Liu ..... H01Q 21/062
2005/0024282 A1 2/2005 Apostolos
2009/0284430 A1 * 11/2009 Liu ..... H01Q 21/0075 343/810
2011/0241953 A1 10/2011 Su
2012/0081259 A1 4/2012 Regala
2015/0118972 A1 * 4/2015 Montgomery ..... G01R 29/10 455/75
2015/0214634 A1 4/2015 Montgomery et al.
(Continued)

FOREIGN PATENT DOCUMENTS

CN 102280687 A 12/2011
CN 203813022 U 9/2014
(Continued)

*Primary Examiner* — Alexander H Taningco
*Assistant Examiner* — Amy X Yang
(74) *Attorney, Agent, or Firm* — McClure, Qualey & Rodack, LLP

(57) ABSTRACT

An antenna system is configured to transceive a wireless signal. The antenna system includes a first dipole antenna and a second dipole antenna. The first dipole antenna includes a first radiator, a second radiator, and a first feeding point. The second dipole antenna includes a third radiator, a fourth radiator, and a second feeding point. The first radiator and the third radiator have a notch facing towards a first direction. The second radiator and the fourth radiator have a notch facing towards a second direction inverse to the first direction. The first feeding point, disposed between the first radiator and the second radiator, is located on one side of the first dipole antenna adjacent to the second dipole antenna. The second feeding point, disposed between the third radiator and the fourth radiator, is located on one side of the second dipole antenna adjacent to the first dipole antenna.

11 Claims, 6 Drawing Sheets

(56) References Cited

U.S. PATENT DOCUMENTS

| | | | | |
|---|---|---|---|---|
| 2015/0372382 | A1* | 12/2015 | Lenart | H01Q 9/16 455/562.1 |
| 2016/0028166 | A1* | 1/2016 | Le | H01Q 21/24 343/816 |
| 2017/0256854 | A1 | 9/2017 | Hu | |

FOREIGN PATENT DOCUMENTS

| | | | |
|---|---|---|---|
| CN | 204375927 | U | 6/2015 |
| CN | 204391251 | U | 6/2015 |
| CN | 204857945 | U | 12/2015 |
| CN | 105789913 | A | 7/2016 |
| CN | 205543223 | U | 8/2016 |
| CN | 106340711 | A | 1/2017 |
| CN | 106450712 | A | 2/2017 |
| CN | 106450715 | A | 2/2017 |
| CN | 106911012 | A | 6/2017 |
| CN | 107017459 | A | 8/2017 |
| CN | 107134648 | A | 9/2017 |
| CN | 206564326 | U | 10/2017 |

* cited by examiner

ANTENNA SYSTEM

This application claims the benefit of People's Republic of China application Serial No. 201820255966.3, filed Feb. 13, 2018, the subject matter of which is incorporated herein by reference.

BACKGROUND OF THE INVENTION

Field of the Invention

The invention relates in general to an antenna system, and more particularly to an antenna system including multiple dipole antennas.

Description of the Related Art

Along with the advance in technology, wireless communication has been widely used in people's everyday life. Antenna plays a very important role in ordinary wireless communication products. Antenna radiates signals with specific frequencies to transmit data wirelessly. However, the radiation pattern and the polarized direction of the antenna will affect the performance of the wireless communication products in terms of the transmission and reception of signals. As the users' requirement of the transmission rate is getting higher and higher, multi-antenna technology is used to provide higher spectrum utilization. Therefore, it has become prominent for the industries to install multiple antennas within the limited space of a wireless communication product.

SUMMARY OF THE INVENTION

The invention is directed to an antenna system capable of effectively increasing isolation between multiple antennas.

According to one embodiment of the present invention, an antenna system configured to transceive a wireless signal is provided. The antenna system includes a first dipole antenna and a second dipole antenna. The first dipole antenna includes a first radiator, a second radiator, and a first feeding point. The first radiator has a notch facing towards a first direction. The second radiator has a notch facing towards a second direction inverse to the first direction. The first feeding point is disposed between the first radiator and the second radiator and is coupled to a signal source. The second dipole antenna includes a third radiator, a fourth radiator, and a second feeding point. The third radiator has a notch facing towards the first direction. The fourth radiator has a notch facing towards the second direction. The second feeding point is disposed between the third radiator and the fourth radiator and is coupled to a signal source. The first feeding point is located on one side of first dipole antenna adjacent to the second dipole antenna. The second feeding point is located on one side of second dipole antenna adjacent to the first dipole antenna.

The above and other aspects of the invention will become better understood with regard to the following detailed description of the preferred but non-limiting embodiment (s). The following description is made with reference to the accompanying drawings.

DETAILED DESCRIPTION OF THE INVENTION

In the specification disclosed below, any numerical values used in the description of an embodiment should be regarded "approximately" under normal circumstance, and any numerical parameters exemplified in the embodiment are approximate values only, which can be changed according to the expected characteristics that any particular embodiment aims to achieve. Besides, due to the error that may occur during a manufacturing process or a measuring process, the term "substantially" (such as substantially equivalent to, substantially perpendicular to, or substantially parallel to) means "approximately". For example, each of the exemplified numerical value has a tolerance range of ±5%.

Figure 1A:
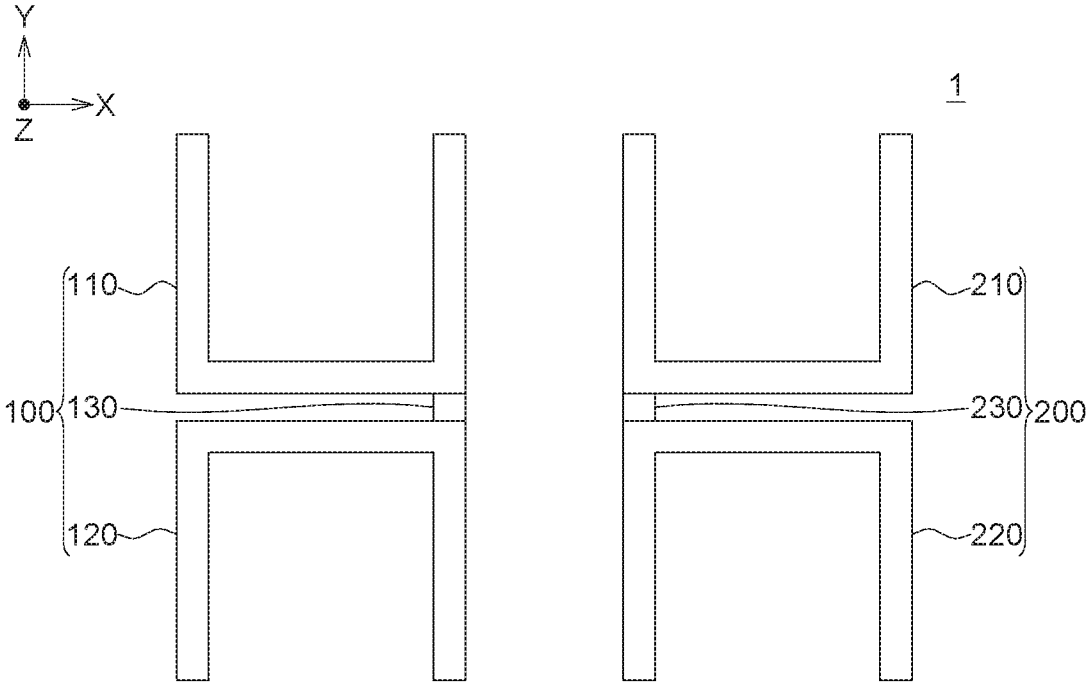
FIG. 1A and FIG. 1B are schematic diagrams of an antenna system according to an embodiment of the invention.

FIG. 1A is a schematic diagram of an antenna system according to an embodiment of the invention. The antenna system 1 is configured to transceive wireless signals. The antenna system 1 includes a first dipole antenna 100 and a second dipole antenna 200. The first dipole antenna 100 includes a first radiator 110, a second radiator 120, and a first feeding point 130. The first radiator 110 and the second radiator 120 are coplanar (on the XY plane in the present example) and are formed of metal. The first radiator 110 has a notch facing towards a first direction. The second radiator 120 has a notch facing towards a second direction inverse to the first direction. In the present example, the first direction is the positive Y-axis direction, and the second direction is the negative Y-axis direction. The first feeding point 130, disposed between the first radiator 110 and the second radiator 120, is coupled to a signal source, such as a signal transmission wire.

The second dipole antenna 200 includes a third radiator 210, a fourth radiator 220, and a second feeding point 230. The third radiator 210 has a notch facing towards the first direction. The fourth radiator 220 has a notch facing towards the second direction. The second feeding point 230 is disposed between the third radiator 210 and the fourth radiator 220. In this embodiment, the second feeding point 230 and the first feeding point 130 are coupled to the same signal source. That is, when the antenna system 1 is in operation, the same signals are fed to the first dipole antenna 100 and the second dipole antenna 200 at the same time. The first feeding point 130 is located on one side of first dipole antenna 100 adjacent to the second dipole antenna 200. The second feeding point 230 is located on one side of second dipole antenna 200 adjacent to the first dipole antenna 100. For example, the first dipole antenna 100 and the second dipole antenna 200 can be arranged side by side, and the first feeding point 130 and the second feeding point 230 can be respectively disposed at the edge of the first dipole antenna 100 and the edge of the second dipole antenna 200.

In an embodiment, the first dipole antenna 100 and the second dipole antenna 200 can have the same structure and the same size, and therefore can form a symmetric structure. However, the said arrangement is exemplified in an illustrative sense only. In other embodiments, the first dipole antenna 100 and the second dipole antenna 200 can have different structures, shapes and sizes, such that required resonance frequency and radiation pattern can be obtained.

Figure 1B:
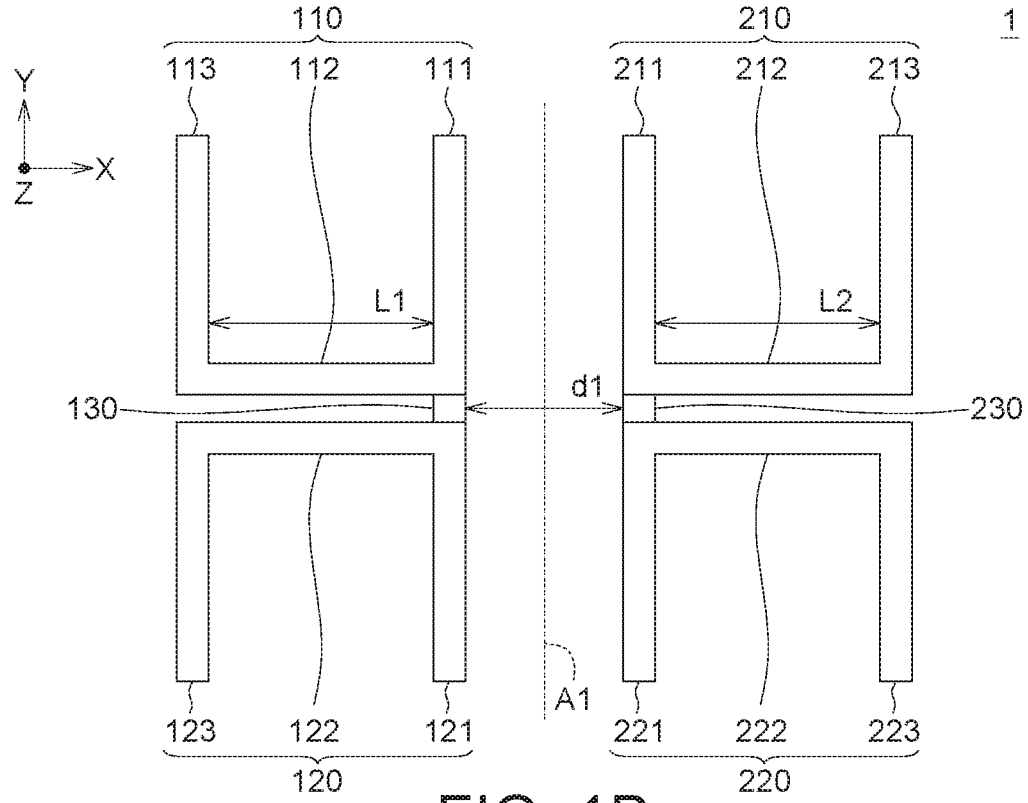

Referring to FIG. 1B, an embodiment of an antenna system 1 with symmetric structure is shown. In the present example, the first dipole antenna 100 and the second dipole antenna 200 are symmetric with respect to a reference axis A1, that is, the first dipole antenna 100 and the second dipole antenna 200 form reflection symmetry.

The first feeding point 130 and the second feeding point 230 are separated by an interval dl, and can also be symmetric with respect to the reference axis A1. In an embodiment, the interval dl is smaller than ¼ times of the wavelength of the wireless signal transceived by the antenna system 1, such that the first dipole antenna 100 can couple the energy to the second dipole antenna 200 to generate a current in reverse direction in the second dipole antenna 200 and a reverse mode is generated in the second dipole antenna 200 by resonance. Thus, the isolation between the first dipole antenna 100 and the second dipole antenna 200 can be improved. As an example, given that the wireless signal has a frequency of 5 GHz and a wavelength of 6 cm, the interval dl between the first feeding point 130 and the second feeding point 230 can be smaller than 1.5 cm. Therefore, the antenna system 1 can be disposed in the limited space of a wireless communication product, and the space requirement of the wireless communication product in terms of hardware can be effectively reduced.

The first radiator 110 includes an inner-side segment 111, a central segment 112, and an outer-side segment 113, which are connected in order. The three segments 111-113 can form a notch facing towards the first direction, and any two adjacent segments are substantially perpendicular to each other. The second radiator 120 includes an inner-side segment 121, a central segment 122, and an outer-side segment 123, which are connected in order. The three segments 121-123 can form a notch facing towards the second direction, and any two adjacent segments are substantially perpendicular to each other. In the example illustrated in FIG. 1B, the first radiator 110 and the second radiator 120 form a top-down symmetric structure. However, it should be understood that the present disclosure is not limited thereto. For example, the inner-side segment 111 of the first radiator 110 and the inner-side segment 121 of the second radiator 120 can have different lengths; or, the first radiator 110 and the second radiator 120 can have different shapes.

Similarly, the third radiator 210 includes an inner-side segment 211, a central segment 212, and an outer-side segment 213, which are connected in order. The fourth radiator 220 includes an inner-side segment 221, a central segment 222, and an outer-side segment 223, which are connected in order.

In an embodiment, the central segment 112 of the first radiator 110 is substantially parallel to the central segment 122 of the second radiator 120, the length L1 of the central segment 112 and that of the central segment 122 are associated with the resonance frequency of the first dipole antenna 100. For example, the length L1 of the central segment 112 of the first radiator 110 can be between ⅛ to ½ times of the wavelength of the wireless signal transceived by the antenna system 1. For example, the length L1 is equivalent to ¼ times of the wavelength of the wireless signal transceived by the antenna system 1.

Similarly, the central segment 212 of the third radiator 210 is substantially parallel to the central segment 222 of the fourth radiator 220. The length L2 of the central segment 212 of the third radiator 210 can be between ⅛ to ½ times of the wavelength of the wireless signal transceived by the antenna system 1. For example, the length L2 is equivalent to ¼ times of the wavelength of the wireless signal transceived by the antenna system 1.

Viewing from the first dipole antenna 100, the first feeding point 130 is disposed at the edge of the first dipole antenna 100, and the two central segments 112 and 122 (the length L1 is about ¼ times of the wavelength) can generate an effect similar to that generated by a resonant cavity. Through the edge feeding mechanism, the energy can be radiated toward the same direction, and the antenna gain can therefore be effectively increased. In the example illustrated in FIG. 1B, the radiation energy of the first dipole antenna 100 is concentrated towards the negative X-axis direction, the antenna gain can be more than 5 dBi, and the radiation energy of the second dipole antenna 200 is concentrated towards the positive X-axis direction. By comparison, the conventional dipole antenna, in which signals are fed via a center point, has an antenna gain about 2 dBi.

The inner-side segment 111 of the first radiator 110 is substantially parallel to the inner-side segment 211 of the third radiator 210. The inner-side segment 121 of the second radiator 120 is substantially parallel to the inner-side segment 221 of the fourth radiator 220. The outer-side segment 113 of the first radiator 110 is substantially parallel to the outer-side segment 213 of the third radiator 210. The outer-side segment 123 of the second radiator 120 is substantially parallel to the outer-side segment 223 of the fourth radiator 220. The first feeding point 130 is adjacent to the junction between the inner-side segment 111 and the central segment 112 of the first radiator 110. The second feeding point 230 is adjacent to the junction between the inner-side segment 211 and the central segment 212 of the third radiator 210.

Figure 2:
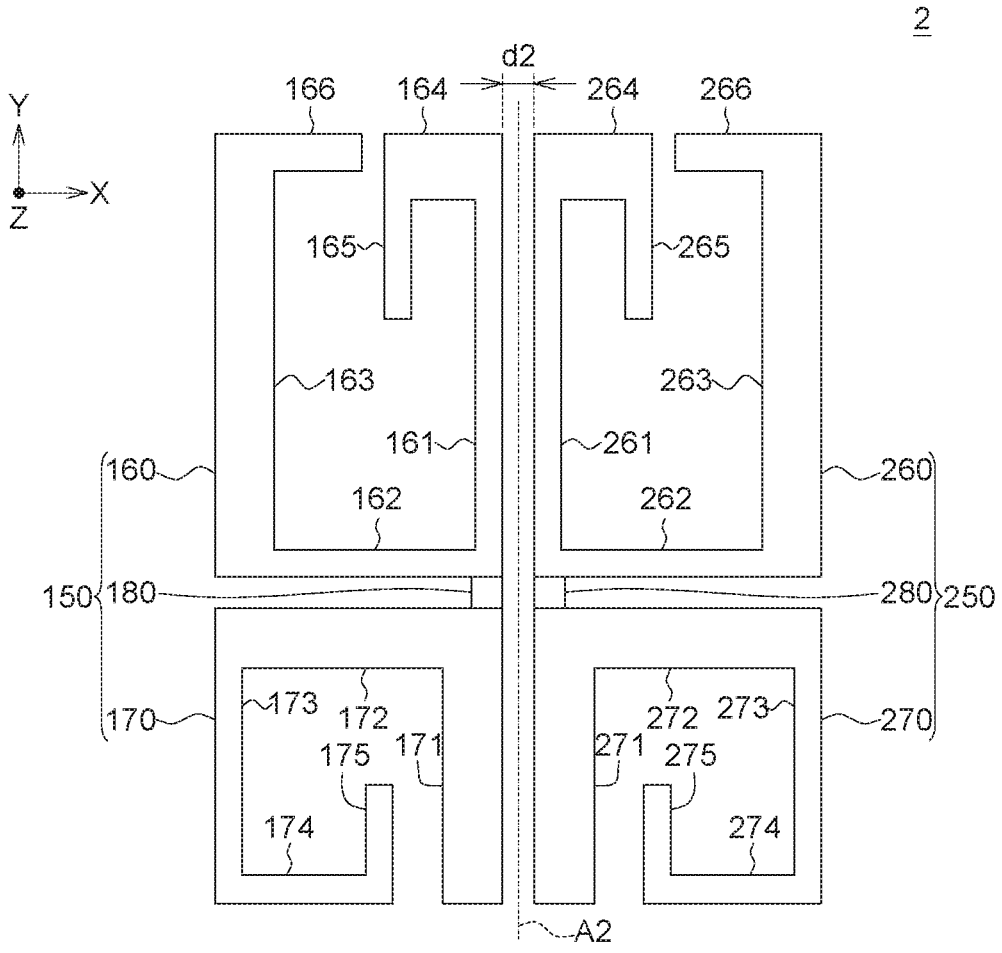
FIG. 2 is a schematic diagram of an antenna system according to another embodiment of the invention.

FIG. 2 is a schematic diagram of an antenna system according to another embodiment of the invention. The antenna system 2 includes a first dipole antenna 150 and a second dipole antenna 250, which are symmetric with respect to a reference axis A2. The first dipole antenna 150 includes a first radiator 160, a second radiator 170, and a first feeding point 180. The second dipole antenna 250 includes a third radiator 260, a fourth radiator 270, and a second feeding point 280. The first feeding point 180 and the second feeding point 280 are separated by an interval d2 smaller than ¼ times of the wavelength of the wireless signal transceived by the antenna system 2.

The antennas of the embodiments as indicated in FIG. 2 and FIG. 1A have different shapes. In FIG. 2, the first radiator 160 includes six segments 161-166, and any two adjacent segments can be connected and perpendicular to each other; the third radiator 260 is symmetric to the first radiator 160 and also includes six segments 261-266. The second radiator 170 includes five segments 171-175, and any two adjacent segments can be connected and perpendicular to each other; the fourth radiator 270 is symmetric to the second radiator 170 and also includes five segments 271-275. However, the said arrangement is exemplified in an illustrative sense only, and the shape of the antenna system 2 is not limited thereto. Through suitable arrangement in the quantity and length of the segments of each radiator, the matching characteristics of antennas can be adjusted.

Figure 3A:
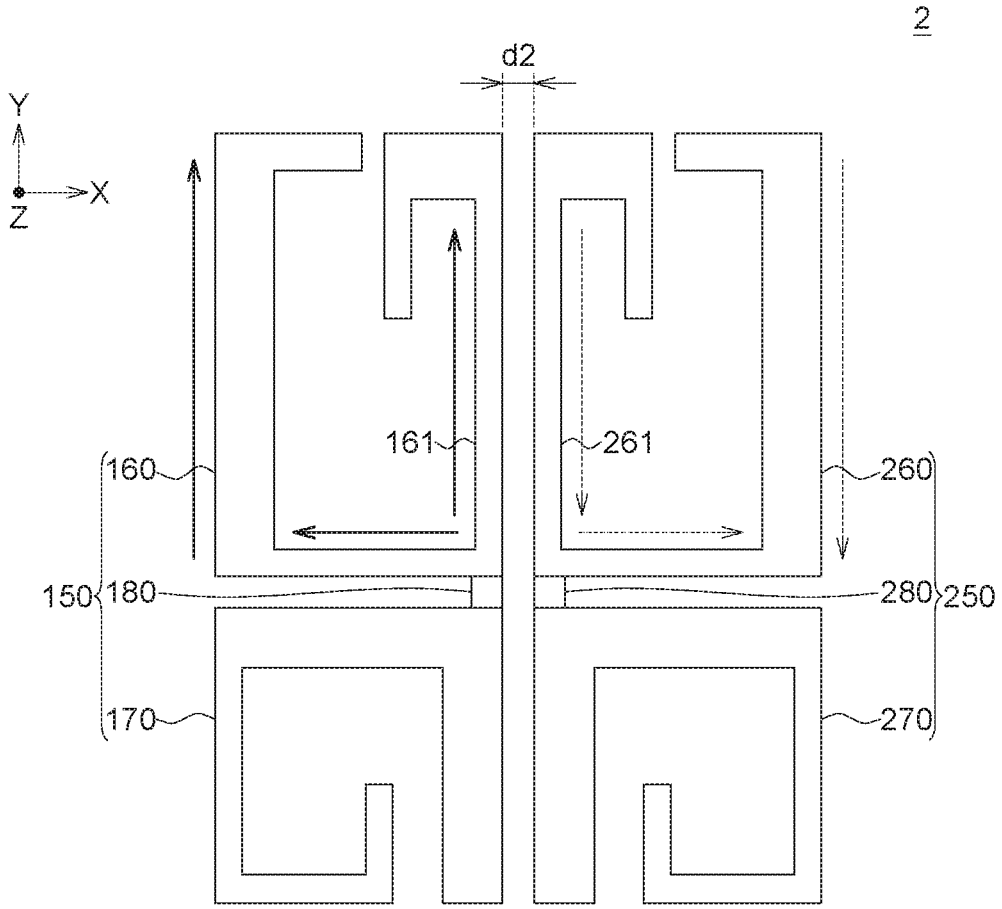
FIG. 3A and FIG. 3B show the current generated in the antenna system of FIG. 2.
Figure 3B:
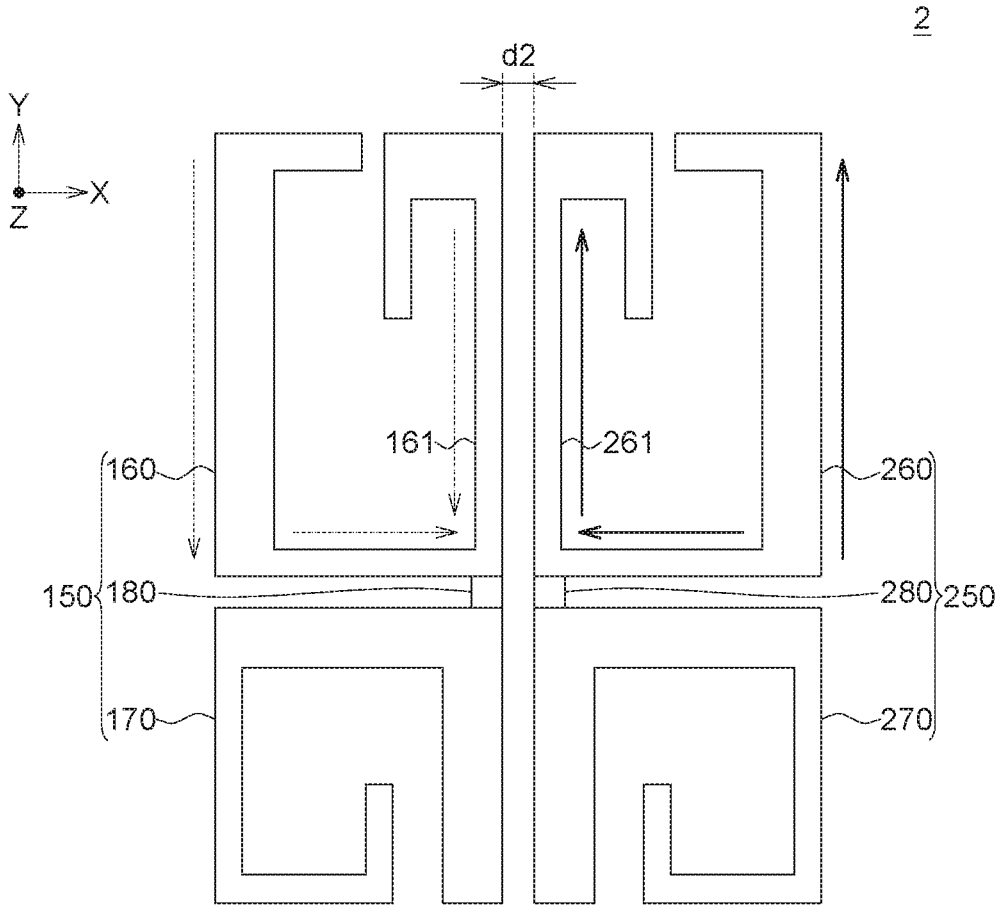

FIG. 3A and FIG. 3B show the current generated in the antenna system of FIG. 2. FIG. 3A illustrates the situation when signals are fed via the first feeding point 180 of the first dipole antenna 150. The solid line arrows represent an actual current of the first dipole antenna 150. The dotted line arrows represent a reverse current generated when the energy is coupled to the second dipole antenna 250. The actual current has a larger current density and the reverse current has a smaller current density. Similarly, FIG. 3B illustrates the situation when signals are fed via the second feeding point 280 of the second dipole antenna 250. The solid line arrows represent an actual current of the second dipole antenna 250. The dotted line arrows represent a reverse current generated when the energy is coupled to the first dipole antenna 150. The actual current has a larger current density and the reverse current has a smaller current density. Through the arrangement of the first dipole antenna 150 and the second dipole antenna 250 being enough closely disposed, a reverse mode can be generated by resonance and the interference between the first dipole antenna 150 and the second dipole antenna 250 can be reduced. For example, through the parallel arrangement between the inner-side segment 161 of the first radiator 160 and the inner-side segment 261 of the third radiator 260, the reverse current can be generated through resonance, and the isolation can be increased.

Figure 4A:
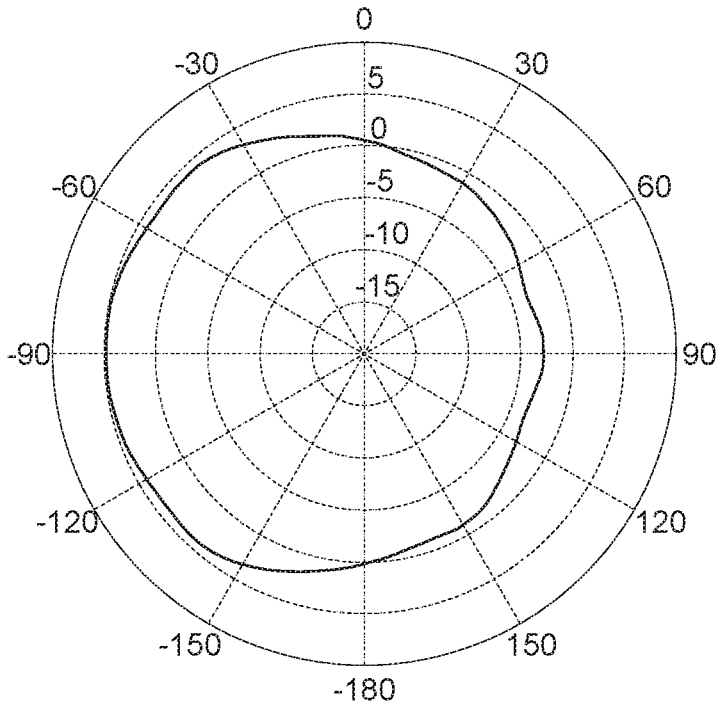
FIG. 4A and FIG. 4B show the radiation patterns of the antenna system of FIG. 2 on the XZ plane.
Figure 4B:
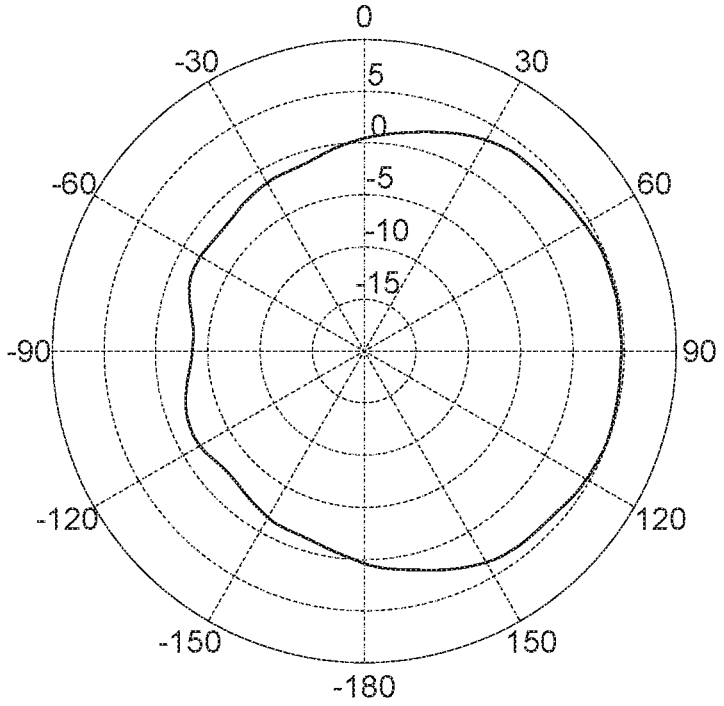

FIG. 4A and FIG. 4B are radiation patterns of the antenna system of FIG. 2 on the XZ plane. As indicated in FIG. 4A, being a radiation pattern of the first dipole antenna 15, the radiation energy is concentrated towards the negative X-axis direction. As indicated in FIG. 4B, being a radiation pattern of the second dipole antenna 250, the radiation energy is concentrated towards the positive X-axis direction. Since both of the first dipole antenna 150 and the second dipole antenna 250 adopt the edge feeding mechanism (the signal is fed through an edge of the antenna), the radiation patterns are directional, the energy can be more concentrated, and the antenna gain can be increased.

Figure 5:
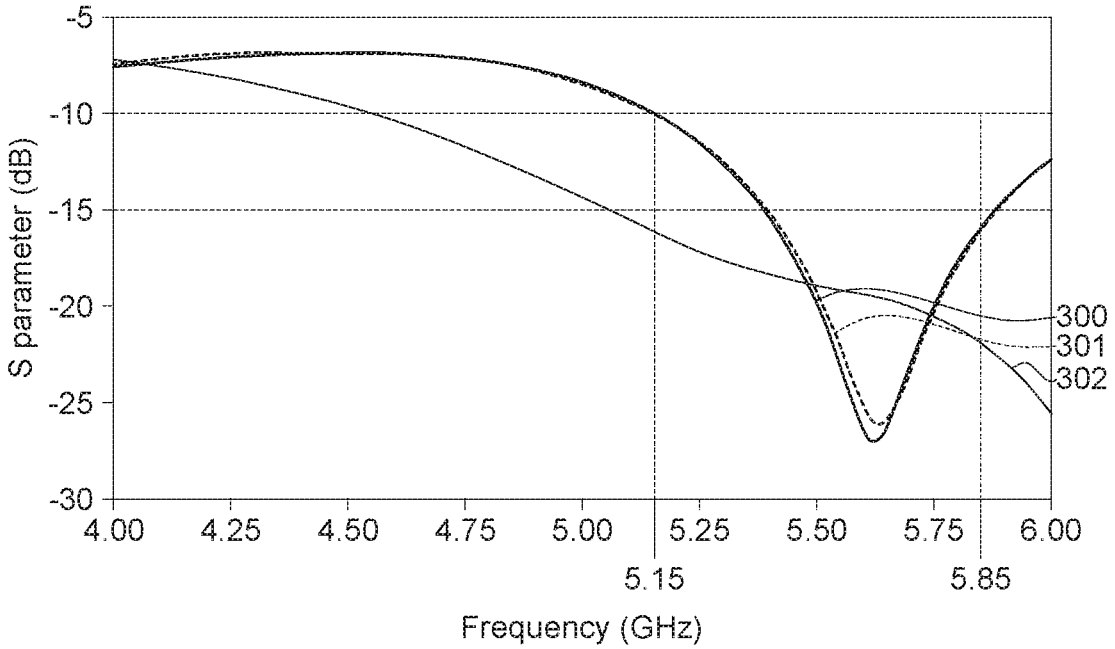
FIG. 5 shows an S parameter diagram of the antenna system of FIG. 2.

FIG. 5 is an S parameter diagram of the antenna system of FIG. 2. Curve 300 represents an S11 parameter of the first dipole antenna 150. The S11 parameter relates to return loss. Curve 301 represents an S11 parameter of the second dipole antenna 250. Within the frequency range of 5.15 GHz-5.85 GHz, the S11 parameter of the first dipole antenna 150 and the S11 parameter of the second dipole antenna 250 are both smaller than −10 dB. This shows that the frequency range of 5.15 GHz-5.85 GHz is an operating frequency range of the antenna system 2. Curve 302 represents an S21 parameter, that is, antenna isolation between the first dipole antenna 150 and the second dipole antenna 250. Within the frequency range of 5.15 GHz-5.85 GHz, S21 is smaller than −15 dB. This shows that within the operating frequency range of the antenna system 2, the interference between the first dipole antenna 150 and the second dipole antenna 250 is low enough, therefore the first dipole antenna 150 and the second dipole antenna 250 can form a dipole antenna with high isolation and high gain.

According to the above embodiments of the present invention, through the feeding signal through an edge of the dipole antenna, energy is consistently radiated towards the same direction, and antenna gain can be increased. Since there is no need to install additional reflectors or adopt an array structure in order to increase the antenna gain, both the hardware space and the manufacturing cost can be effectively reduced.

Additionally, through the side by side design of two dipole antennas, the energy can be coupled from one antenna to the other antenna, a reverse current is generated in the other antenna, and a reverse mode can be generated by resonance, such that the isolation within the operating frequency range of the two dipole antennas can be increased. Since there is no need to change the structure of the ground plane, to extend the current path of the ground plane, or to change the angle of the antenna in order to increase the isolation between antennas, the hardware space can be effectively saved. In the present disclosure, the two antennas are separated by a very small interval, and therefore can be disposed within the limited space of the wireless communication product.

The antenna system disclosed in above embodiments can be disposed in multiple types of communication devices, such as small-sized base stations (e.g. small cell or femto cell), wireless access points (AP), passive optical network (PON) devices, routers, or electronic devices using different wireless communication protocols. Examples of the wireless communication protocols include Wi-Fi, Bluetooth low energy (BLE), ZigBee, Z-wave, digital enhanced cordless telecommunications (DECT), and long term evolution (LTE). The antenna system disclosed above can be used in different manufacturing processes such as a printed circuit board (PCB) process, a flexible printed circuit (FPC) process, the iron sheet process, and a laser direct structuring (LDS) process, and has a wide range of application.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna system configured to transceive a wireless signal, comprising:

a first dipole antenna, comprising:

a first radiator having a notch facing towards a first direction;

a second radiator having a notch facing towards a second direction inverse to the first direction; and a first feeding point disposed between the first radiator and the second radiator; and a second dipole antenna, comprising:

a third radiator having a notch facing towards the first direction;

a fourth radiator having a notch facing towards the second direction; and a second feeding point disposed between the third radiator and the fourth radiator;

wherein the first feeding point is located on one side of the first dipole antenna adjacent to the second dipole antenna, and the second feeding point is located on one side of the second dipole antenna adjacent to the first dipole antenna;

wherein the first dipole antenna and the second dipole antenna are coplanar.

2. The antenna system according to claim 1, wherein the first dipole antenna and the second dipole antenna are symmetric with respect to a reference axis.

3. The antenna system according to claim 1, wherein the first feeding point and the second feeding point are separated by an interval smaller than ¼ times of the wavelength of the wireless signal.

4. The antenna system according to claim 1, wherein each of the first radiator, the second radiator, the third radiator, and the fourth radiator comprises an inner-side segment, a central segment, and an outer-side segment, which are connected in order, the central segment of the first radiator is parallel to the central segment of the second radiator, and the central segment of the third radiator is parallel to the central segment of the fourth radiator.

5. The antenna system according to claim 4, wherein the central segment of the first radiator has a length between ⅛ to ½ times of the wavelength of the wireless signal.

6. The antenna system according to claim 4, wherein the inner-side segment of the first radiator is parallel to the inner-side segment of the third radiator and the inner-side segment of the second radiator is parallel to the inner-side segment of the fourth radiator.

7. The antenna system according to claim 6, wherein the first feeding point is adjacent to the junction between the inner-side segment and the central segment of the first radiator, and the second feeding point is adjacent to the junction between the inner-side segment and the central segment of the third radiator.

8. The antenna system according to claim 1, wherein each of the first radiator, the second radiator, the third radiator, and the fourth radiator comprises a plurality of segments connected perpendicularly in order.

9. The antenna system according to claim 1, wherein the first feeding point and the second feeding point are coupled to the same signal source.

10. The antenna system according to claim 1, wherein each of the first radiator and the third radiator comprises an inner-side segment, a central segment, and an outer-side segment, which are connected in order, and the first feeding point and the second feeding point are separated, in an extension direction of the central segment of the first radiator, by an interval.

11. An antenna system configured to transceive a wireless signal, comprising:

a first dipole antenna, comprising:

a first radiator having a notch facing towards a first direction;

a second radiator having a notch facing towards a second direction inverse to the first direction; and a first feeding point disposed between the first radiator and the second radiator; and a second dipole antenna, comprising:

a third radiator having a notch facing towards the first direction;

a fourth radiator having a notch facing towards the second direction; and a second feeding point disposed between the third radiator and the fourth radiator;

wherein the first feeding point is located on one side of the first dipole antenna adjacent to the second dipole antenna, and the second feeding point is located on one side of the second dipole antenna adjacent to the first dipole antenna;

wherein each of the first radiator and the third radiator comprises an inner-side segment, a central segment, and an outer-side segment, which are connected in order, and the first feeding point and the second feeding point are separated, in an extension direction of the central segment of the first radiator, by an interval.

* * * * *